US005079123A

United States Patent [19]

Nanya et al.

[11] Patent Number: 5,079,123

[45] Date of Patent: Jan. 7, 1992

[54] DRY-TYPE TONER FOR ELECTROPHOTOGRAPHY WITH CARNAUBA WAX

[75] Inventors: Toshiki Nanya, Mishima; Kimitoshi Yamaguchi; Hiromitsu Kawase, both of Numazu, all of Japan

[73] Assignee: Ricoh Company, Ltd., Tokyo, Japan

[21] Appl. No.: 530,633

[22] Filed: May 30, 1990

[30] Foreign Application Priority Data

Jun. 2, 1989 [JP] Japan ..... 1-139132

[51] Int. Cl.[5] ..... G03G 9/083; G03G 9/097

[52] U.S. Cl. ..... 430/106.6; 430/110

[58] Field of Search ..... 430/106.6, 110

[56] References Cited

U.S. PATENT DOCUMENTS 3,983,045 9/1976 Jugle et al. ..... 430/110

FOREIGN PATENT DOCUMENTS 231562 10/1986 Japan ..... 430/110
1-85662 7/1989 Japan ..... 430/110
2-17467 8/1989 Japan ..... 430/110

*Primary Examiner*—Roland Martin
*Attorney, Agent, or Firm*—Cooper & Dunham

[57] ABSTRACT

A dry-type toner for electrophotography comprising a binder resin, a coloring agent, and, as a lubricant, a carnauba wax substantially free of free aliphatic acids. The toner may further comprise a magnetic material, and the resulting toner mixture can be used as a magnetic toner.

7 Claims, No Drawings

DRY-TYPE TONER FOR ELECTROPHOTOGRAPHY WITH CARNAUBA WAX

BACKGROUND OF THE INVENTION

1. Field of the Invention

This invention relates to a dry-type toner for use in electrophotography and electrostatic printing to develop latent electric or magnetic images, and more particularly to a dry-type toner which exhibits high fixing ability even at low image-fixing temperatures and can be used in a thermal image fixing method employing an oil-less heat-application roller.

2. Discussion of Background

Latent electrostatic images formed in the course of electrophotography, electrostatic printing and electrostatic recording are developed with, in the case of a dry method, a dry-type toner comprising as its main components a binder resin and a coloring agent. The developed images are transferred to the surface of a copy paper, and then fixed thereon.

Toner images can be fixed on a copy paper by various image fixing methods. Among them, a thermal image fixing method using a heat-application roller is widely adopted, because high thermal efficiency can be obtained and high-speed fixation can be achieved when this method is employed.

In order to achieve high-speed fixation by the thermal image fixing method, a toner used therein is required to exhibit high image fixing ability even at low fixing temperatures. Therefore, a resin having a low softening point is incorporated into the toner as a binder resin.

However, when such a resin is contained in the toner, the toner images partially stick to the surface of a heat-application roller during the process of image fixing, and the toner stuck to the roller-surface transfers to a copy paper to stain the background. This is a so-called off-set phenomenon. Furthermore, the copy paper tends to wind round the heat-application roller when the temperature of the roller is low. In this Specification, this phenomenon is referred to as a "winding phenomenon".

In order to eliminate the above adverse phenomena, the addition of a lubricant or releasant, such as a solid silicone, a varnish, a higher fatty acid, a higher alcohol or a wax of various kinds, has been proposed as disclosed in Japanese Laid-Open Patent Applications 51-143333, 57-148752, 58-97056 and 60-247250. However, toners containing any of the above lubricants do not exhibit high resistance to the off-set and winding phenomena while maintaining high fixing ability at low temperatures.

For instance, polyolefin waxes such as a low-molecular-weight polyethylene and a low-molecular-weight polypropylene, which have conventionally been used in a toner as a lubricant, can impart to the toner high resistance to the off-set phenomenon, but cannot sufficiently improve the fixing ability at low temperatures.

Vegetable waxes such as carnauba wax and candelilla wax can impart to a toner both high resistance to the off-set phenomenon and excellent fixing ability at low temperatures, but cannot impart to the toner high resistance to the winding phenomenon.

Solid silicones, varnishes, silicone oils, amide waxes, higher fatty acids, higher alcohols and montan wax can improve the fixing ability at low temperatures, but cannot sufficiently impart to a toner the resistance to the off-set and winding phenomena.

In addition, the conventional lubricants cannot be thoroughly dispersed in a binder resin, so that they tend to separate from the toner during the process of development, and stick to a photoconductor or a development sleeve. A so-called filming problem is thus caused. Furthermore, since a carrier tends to adhere to the toner containing the conventional lubricants, the toner cannot stably produce high quality images for a prolonged period of time.

SUMMARY OF THE INVENTION

Accordingly, one object of the present invention is to provide a dry-type toner for electrophotography, having high resistance to off-set and winding phenomena.

Another object of the present invention is to provide a dry-type toner for electrophotography, exhibiting a low lower limit of the temperature range in which toner images can be fixed on copy paper.

A further object of the present invention is to provide a dry-type toner for electrophotography, which does not stain the background of copy paper, and does not scatter on copy paper during the image fixing process.

Yet another object of the present invention is to provide a dry-type toner for electrophotography, capable of producing images with high fidelity even after the repeated use, and usable for high-speed image fixation.

The above objects of the present invention can be achieved by a dry-type toner for electrophotography, comprising a binder resin, a coloring agent, and a carnauba wax serving as a lubricant or releasant, which is substantially free of free aliphatic acids.

DETAILED DESCRIPTION OF THE PREFERRED EMBODIMENTS

A conventionally employed carnauba wax generally contains 3 to 4 wt. % of free aliphatic acids. By contrast, in the present invention, a carnauba wax which is substantially free of free aliphatic acids is employed. Such a carnauba wax can be obtained from the conventional carnauba wax by removing therefrom the free aliphatic acids to the extent that the content of the free aliphatic acids is preferably 1 wt. % or less.

Due to the removal of the aliphatic acids, the acid value of the carnauba wax for use in the present invention is 1% or less, and the size of its crystal is 1 μm or less, when dispersed in a binder resin, which is much smaller than that of the conventional carnauba wax, and can thus be much better dispersed in the binder resin than the conventional carnauba wax. For this reason, a toner containing the carnauba wax as a lubricant is free from the previously-mentioned filming problem, and a carrier does not adhere to the toner. Moreover, the toner exhibits high resistance to both the off-set and the winding phenomena.

A toner comprising a carnauba wax containing more than 1 wt. % of free aliphatic acids exhibits low resistance to the winding phenomenon.

The incorporation amount of the carnauba wax is, in general, 0.5 to 20 wt. %, preferably 1 to 10 wt. %, of the weight of the binder resin.

The other components to be contained in the toner of the present invention will be explained below.

Various thermoplastic resins which have been used in the conventional toners can be used as the binder resin in the present invention.

Specific examples of the thermoplastic resins usable in the present invention include homopolymers of styrene or its substitution compounds such as polystyrene, poly-p-chlorostyrene and polyvinyltoluene, styrene-based copolymers such as a styrene - p-chlorostyrene copolymer, a styrene-propylene copolymer, a styrene - vinyltoluene copolymer, a styrene - vinylnaphthalene copolymer, a styrene - methylacrylate copolymer, a styrene - ethylacrylate copolymer, a styrene -butylacrylate copolymer, a styrene - octylacrylate copolymer, a styrene - methylmethacrylate copolymer, a styrene - ethylmethacrylate copolymer, a styrene - butylmethacrylate copolymer, a styrene - methyl-α-chloromethacrylate copolymer, a styrene - acrylonitrile copolymer, a styrene - vinylmetyl ether copolymer, a styrene - vinylethyl ether copolymer, a styrene - vinylmethyl ethyl ketone copolymer, a styrene - butadiene copolymer, a styrene-isoprene copolymer, a styrene - acrylonitrile - indene copolymer, a styrene - maleic acid copolymer and a styrene-maleic acid ester copolymer, polymethyl methacrylate, polybutyl methacrylate, polyvinyl chloride, polyvinyl acetate, polyethylene, polypropylene, polyester, polyurethane, polyamide, an epoxy resin, polyvinyl butyral, a polyacrylic acid resin, rosin, modified rosin, a terpene resin, a phenol resin, an aliphatic hydrocarbon resin, an alicyclic hydrocarbon resin, an aromatic petroleum resin, chlorinated paraffin, and a paraffin wax. The above resins can be used either singly or in combination.

Of the above resins, a styrene-based resin containing both a high-molecular-weight component and a low-molecular-weight component with the ratio (Mw/Mn) of the weight-average molecular weight (Mw) to the number-average molecular weight (Mn) being 3.5 or greater, and a polyester resin are preferred because they can impart to the toner high fixing ability and high resistance to the winding phenomenon.

In the present invention, as the coloring agent can be used any of the known dyes and pigments such as carbon black, Lamp Black, Iron Black, Ultramarine Blue, Nigrosine dyes, Aniline Blue, Phthalocyanine Blue, Phthalocyanine Green, Hansa Yellow G, Rhodamine 6G, lake, Calconyl Blue, Chrome Yellow, quinacridone, Benzidine Yellow, Rose Bengale, triallyl methane dyes, monoazo pigments, and disazo pigments. The above dyes and pigments can be used either singly or in combination.

The incorporation amount of the coloring agent is, in general, 1 to 30 wt. %, preferably 3 to 20 wt. %, of the weight of the binder resin.

The toner according to the present invention can also be used as a two-component-type developer. In this case, the toner is mixed with a carrier powder. As such a carrier powder, any of the conventionally known carrier powder can be used. Examples of the carrier powder include powders having magnetic properties such as iron powder, ferrite powder and nickel powder, and glass beads. Furthermore, the above magnetic powders and glass beads can also be coated with a resin.

The toner of the present invention can be used as a magnetic toner by incorporating therein a magnetic material.

Examples of the magnetic material include iron oxides such as magnetite, hematite and ferrite, metals such as iron, cobalt and nickel, alloys or mixtures of any of the above metals and a metal such as aluminium, cobalt, copper, lead, magnesium, tin, zinc, antimony, beryllium, bismuth, cadmium, calcium, manganese, selenium, titanium, tungsten or vanadium.

The average diameter of the magnetic material is preferably 0.1 to 2 μm, and its incorporation amount is approximately 20 to 200 parts by weight, preferably 40 to 150 parts by weight, per 100 parts by weight of the binder resin contained in the toner.

Moreover, the toner of the present invention may further comprise any of the following auxiliary components, if necessary: a releasant such as Teflon or zinc stearate, an abrasive substance such as cerium oxide or silicon carbide, a fluidity-imparting agent such as colloidal silica or aluminum oxide, a caking-preventing agent, an electro-conductivity-imparting agent such as carbon black or tin oxide, and a fixing-accelerating agent such as polyolefin having a low molecular weight.

Other features of this invention will become apparent in the course of the following description of exemplary embodiments, which are given for illustration of the invention and are not intended to be limiting thereof.

EXAMPLE 1

The following components were thoroughly mixed in a Henschel mixer.

| | parts by weight |
|---|---|
| Polyester resin (Number-average molecular weight Mn = 5000, Weight-average molecular weight Mw = 55000, Glass transition temperature Tg = 62° C.) | 95 |
| Carnauba wax A containing 1.0 wt. % of free aliphatic acids (Melting point = 83° C., Acid value = 1.0) | 5 |
| Carbon black (Trademark, "#44", made by Mitsubishi Carbon Co., Ltd.) | 10 |
| Chromium-containing monoazo dye Trademark, "TRH", made by Hodogaya Chemical Co., Ltd.) | 2 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner having a particle diameter of 5 to 20 μm.

Three parts by weight of the above-obtained toner and 97 part by weight of ferrite carrier particles with a 100 to 250 mesh, coated with a silicone resin, were mixed in a ball mill pot, whereby two-component-type developer No. 1 according to the present invention was obtained.

The thus obtained developer was placed in a plain paper copying apparatus ("FT-7030", Trademark, made by Ricoh Company, Ltd.), equipped with a pair of Teflon-coated fixing rollers composed of a pressure-application roller and a heat-application roller, and images were continuously reproduced while keeping the temperature of the heat-application roller at 130° C. During the reproduction of making 50,000 copies, neither the off-set phenomenon nor the winding phenomenon was observed. From the outset to the 50,000th copy, high quality images were obtained and the quality underwent no deterioration.

The fixing properties of the developer were evaluated in terms of the following temperatures:

(1) the lower limit of the temperature range in which a hot off-set phenomenon is observed, (2) the upper limit of the temperature range in which a cold off-set phenomenon is observed, (3) the temperature at which copy paper begins to wind round the heat-application roller, and (4) the lower limit of the temperature range in which toner images are fixed on copy paper.

More specifically, the temperatures of items (1) and (2) were determined by the following methods:

Toner images transferred onto the surface of a copy paper were fixed thereon under the conditions of a nip width of 4 mm and a line speed of the fixing rollers of 250 mm/sec, with the image fixing temperature changed. The toner gave rise to the off-set phenomenon at a low-temperature region and a high-temperature region. The off-set phenomenon observed in the low-temperature region is referred to as a cold off-set phenomenon, and the one observed in the high-temperature region is referred to as a hot off-set phenomenon. The upper limit of the temperature range in which the toner gave rise to the cold off-set phenomenon, and the lower limit of the temperature range in which the toner gave rise to the hot off-set phenomenon were determined by repeating the image fixing process while changing the temperature of the heat-application roller.

The temperature of item (3) was determined by the following method:

A solid toner image transferred onto almost the entire surface of a copy paper was fixed thereon under the same conditions as described above. The temperature at which the copy paper began to wind round the heat-application roller was measured by repeating the image fixing process while lowering the temperature of the heat-application roller.

The temperature of item (4) was determined by the following method:

Toner images were fixed on a copy paper under the same conditions as described above. The temperature at which 70% of the toner images was fixed on the copy paper was measured by repeating the fixing process while elevating the temperature of the heat-application roller. The image fixing rate was measured by a crockmeter.

The results are shown in Table 1. As shown in the table, all the data obtained in terms of the above items (1) to (4) were satisfactory.

COMPARATIVE EXAMPLE 1

The procedure in Example 1 was repeated except that carnauba wax A containing 1.0 wt. % of free aliphatic acids used in Example 1 was replaced by a low-molecular-weight polypropylene (Trademark, "660P", made by Sanyo Chemical Industries, Ltd.), whereby comparative two-component-type developer No. 1 was obtained.

By using the above-obtained developer, images were continuously reproduced in the same manner as in Example 1. During the reproduction, copy papers wound round the heat-application roller, and high quality images could not be obtained.

The fixing properties of the developer were also evaluated in the same manner as in Example 1. The results are shown in Table 1. As shown in the table, the lower limit of the temperature range in which the developer gave rise to the hot off-set phenomenon was sufficiently high. However, the temperature at which the copy papers began to wind round the heat-application roller was high, and the lower limit of the temperature range in which toner images were fixed on the copy papers was high.

EXAMPLE 2

The following components were thoroughly mixed in a Henschel mixer.

| | parts by weight |
|---|---|
| Styrene - 2-ethylhexylacrylate copolymer (Number-average molecular weight Mn = 12000, Weight-average molecular weight Mw = 420000, Glass transition temperature Tg = 55° C.) | 97 |
| Carnauba wax B containing 0.7 wt. % of free aliphatic acids (Melting point = 84° C., Acid value = 0.6) | 3 |
| Carbon black (Trademark, "#44", made by Mitsubishi Carbon Co., Ltd.) | 13 |
| Zinc salt of salicylic acid (Trademark, "Bontron E-84", made by Oriental Chemical Industries, Ltd.) | 3 |

The resulting mixture was placed in a roll mill pot, and kneaded at temperatures between 80° C. and 110° C. for approximately 40 minutes. The fused mixture was cooled to room temperature, crushed, and then classified, thereby obtaining a toner with a particle diameter of 5 to 20 μm.

3.5 parts by weight of the above-obtained toner and 96.5 parts by weight of oxidized iron powder carrier particles with a 150–250 mesh were mixed in a ball mill pot, whereby two-component-type developer No. 2 according to the present invention was obtained.

Images were continuously reproduced by using the above-obtained developer in the same manner as in Example 1. During the reproduction of making 50,000 copies, neither the off-set phenomenon nor the winding phenomenon was observed. From the outset to the 50,000th copy, high quality images were obtained, and the quality underwent no deterioration.

The fixing properties of the developer were also evaluated in the same manner as in Example 1. The results are shown in Table 1. As shown in the table, the obtained data were all satisfactorily.

EXAMPLE 3

The procedure in Example 1 was repeated except that the amount of the carnauba wax A containing 1.0 wt. % of free aliphatic acids used in Example 1 was changed from 5 parts by weight to 10 parts by weight. whereby two-component-type developer No. 3 according to the present invention was obtained.

Images were continuously reproduced by using the above-obtained developer in the same manner as in Example 1. During the reproduction of making 50,000 copies, neither the off-set phenomenon nor the winding phenomenon was observed. From the outset to the 50,000th copy, high quality images were obtained, and the quality underwent no deterioration.

The fixing properties of the developer were also evaluated in the same manner as in Example 1. The results are shown in Table 1. As shown in the table, the obtained data were all satisfactorily.

COMPARATIVE EXAMPLE 2

The procedure in Example 2 was repeated except that the carnauba wax B containing 0.7 wt. % of free aliphatic acids used in Example 2 was replaced by a carnauba wax containing 4 wt. % of free aliphatic acids, having a melting point of 83.5° C. and an acid value of 4, whereby comparative two-component-type developer No. 2 was obtained.

Images were continuously reproduced by using the above-obtained developer in the same manner as in Example 1. During the reproduction test, copy paper wound round the heat-application roller, and high quality images could not be obtained.

The fixing properties of the developer were also evaluated in the same manner as in Example 1. The results are shown in Table 1. As shown in the table, the lower limit of the temperature range in which the developer gave rise to the hot off-set phenomenon was sufficiently high. However, the temperature at which copy papers began to wind round the thermal roller was high.

TABLE 1

| Developer | (1) | (2) | (3) | (4) |
|---|---|---|---|---|
| No. 1 | 230 | 125 | 125 | 130 |
| No. 2 | 230 | 130 | 125 | 135 |
| No. 3 | 230 | 120 | 120 | 130 |
| Comp. No. 1 | 230 | 155 | 160 | 160 |
| Comp. No. 2 | 230 | 135 | 150 | 135 |

In the above table, the unit of the data is "°C.", and (1), (2), (3) and (4) correspond to items (1) to (4) described in Example 1.

As described above, since the dry-type toners according to the present invention comprise the carnauba wax substantially free of free aliphatic acids, the toners exhibit high resistance to the off-set and the winding phenomena, and the toner images can be firmly fixed on copy paper even at room temperature. Therefore, high-speed fixation can be successfully achieved by using the toners of the present invention. Moreover, the carnauba wax can be well dispersed in a binder resin, so that the toners of the present invention do not cause the problem of filming, and a carrier does not fuse to the toners particles. High quality images can thus be stably obtained for a prolonged period of time.

What is claimed is:

1. A dry-type toner for electrophotography, comprising:

(i) a binder resin, (ii) a coloring agent, and (iii) a carnauba wax which contains 1.0 wt. % or less of free aliphatic acids.

2. The dry-type toner for electrophotography as claimed in claim 1, wherein the amount of said carnauba wax is 0.5 wt. % to 20 wt. % of the weight of said binder resin.

3. The dry-type toner for electrophotography as claimed in claim 1, wherein said binder resin is a styrene-based resin containing both a high-molecular-weight component and a low-molecular weight component with the ratio (Mw/Mn) of the weight-average molecular weight (Mw) to the number-average molecular weight (Mn) being 3.5 or greater.

4. The dry-type toner for electrophotography as claimed in claim 1, wherein said binder resin is a polyester resin.

5. The dry-type toner for electrophotography as claimed in claim 1, further comprising a magnetic material.

6. The dry-type toner for electrophotography as claimed in claim 5, wherein the amount of said magnetic material is 20 to 200 parts by weight of the weight of said binder resin.

7. The dry-type toner for electrophotography as claimed in claim 5, wherein said magnetic material has an average diameter of 0.1 to 2 μm.

* * * * *